US005575537A

United States Patent [19]

Kogler et al.

[11] Patent Number: 5,575,537

[45] Date of Patent: Nov. 19, 1996

[54] TUNNEL DRILLING MACHINE OR TUBE-DRIVING MACHINE

[75] Inventors: Peter Kogler, Knittelfeld, Austria; Günther Koslowski, Bottrop, Germany

[73] Assignee: Alpine Westfalia Berg- und Tunneltechnik GmbH & Co., Lünen, Germany

[21] Appl. No.: 417,053

[22] Filed: Apr. 5, 1995

[30] Foreign Application Priority Data

Apr. 15, 1994 [DE] Germany ..... 44 13 235.2

[51] Int. Cl.[6] ..... E21D 9/10; E21B 10/12

[52] U.S. Cl. ..... 299/31; 175/376; 299/55

[58] Field of Search ..... 299/31, 33, 55, 299/56; 405/138; 175/376, 377, 398, 399

[56] References Cited

U.S. PATENT DOCUMENTS

| | | | |
|---|---|---|---|
| 3,041,055 | 6/1962 | Risse | 175/376 X |
| 4,043,600 | 8/1977 | Dyer | 299/56 X |
| 4,624,605 | 11/1986 | Akesaka | 299/56 X |

FOREIGN PATENT DOCUMENTS

| | | | |
|---|---|---|---|
| 169393 | 6/1989 | European Pat. Off. . | |
| 520909 | 12/1992 | European Pat. Off. | 405/138 |
| 3104203 | 2/1982 | Germany . | |
| 3219362 | 4/1983 | Germany . | |
| 4272392 | 9/1992 | Japan | 405/138 |

*Primary Examiner*—David J. Bagnell
*Attorney, Agent, or Firm*—Cushman, Darby & Cushman

[57] ABSTRACT

The tunnel drilling machine or tube-driving machine for hard rock drilling has a drill head (19) supporting drilling tools (1 to 18) which has a diameter which is less than the diameter of the bore. The geometric axis of the circle of the envelope of the tools of the full-width drill head (19) is disposed eccentrically in relation to the linear tunnel axis (22) or the axis of rotation (21) or can be displaced.

28 Claims, 6 Drawing Sheets

TUNNEL DRILLING MACHINE OR TUBE-DRIVING MACHINE

FIELD OF THE INVENTION

The invention relates to a tunnel drilling machine or a tube-driving machine for hard rock drilling with a rotatably seated full-width drill head supporting the drilling tools.

BACKGROUND OF THE INVENTION

As a rule up to now it was only possible to make repairs to a tunnel drilling machine, in particular in inaccessible tunnel cross sections, if the tunnel drilling machine had been made accessible by additional digging. The removal of the tunnel drilling machine from a tunnel tube is not easily possible, in particular in those cases where safety measures against cave-ins, such as tubbings or cladding with steel rings are required, since it is not always possible to retract the drilling machine through such restrictions of the cross section. Constrictions of the tunnel cross section by convergence can occur with increased rock pressure, which also makes the retraction of the tunnel drilling machine more difficult.

In connection with soft rock and with narrower, inaccessible tunnel cross sections it is known to fold partial areas of the drill head by means of mechanical devices or to reduce its cross section. In general this refers to partial width drilling tools, and different adjustment mechanisms can be found in, for example, U.S. Pat. No. 5,104,262, German Published, Non-Examined Patent Application DE-OS 31 40 203 and German Patent DE-PS 3 219 362. A cutting head which is pivotable to all sides can be found in European Patent Publication EP-B1 169 393, and is movable in a frame in the linear direction of the tunnel tube, this embodiment also being related to a partial width machine. All known devices wherein the tools can be brought into an appropriate position pivotably or together with a cutting head have the disadvantage, particularly in connection with cutting of hard rock, that the additional mechanical devices are subjected to heavy loads and therefore cause an additional susceptibility for breakdown. Incidentally, when cutting hard rock in particular, the employment of full-width drill heads is considerably more advantageous, and up to now the only option for salvaging such full-width drill heads was to dig them out from the surface of the section to be drilled out.

OBJECT AND SUMMARY OF THE INVENTION

It is the object of the invention to further develop an installation of the above mentioned type in such a way that it is possible to dismantle the entire work face and that, if required, the retraction out of the tunnel tube can take place without digging it out.

For attaining this object, the drilling machine or driving machine of the above mentioned type and in accordance with the invention is essentially embodied such that the drill head has a diameter which is less than the diameter of the bore, and that the geometric axis of the circle of the envelope of the tools of the full-width drill head is disposed or can be displaced eccentrically in relation to the axis of rotation or the linear tunnel axis. Because of the employment of a full-width drill head which is moved in a relation to the axis of rotation or the linear tunnel axis in such a way that a relatively large cross section can be removed without additional, mechanically extendible cutting tools, a possibility is now simultaneously created for taking up a position in which the drill head can be retracted again through the tunnel tube by a mere displacement of the axis of rotation, wherein it is sufficient to displace the position of the drill head in relation to the linear tunnel axis. In this case the geometric axis of the full-width drill head is defined by the circle of the envelope of the tools on the full-width drill head. The rotation of such a drill head around an axis of rotation which is different from the geometric axis results in it being possible to remove a larger cross section than would correspond to the cross section of the full-width drill head alone. Conversely, by a simple displacement of the full-width drill head, such an embodiment permits the assumption of a position wherein a retraction of the drill head and the entire tunnel drilling machine is easily possible even in case of existing timbering or encasing or convergences.

The tunnel drilling machine or tube-driving machine in accordance with the invention is advantageously further developed in such a way that the drill head has a support disk on which hard rock tools, such as disks, are disposed. Their radial distance from each other, taking into consideration the eccentricity of the circle of the envelope of the disks in respect to the linear tunnel axis or the axis of rotation, is selected to be such that the distances of the cutting lines from each other are less on a radius which is greater in respect to the linear tunnel axis than when the radius is less. In this connection disks or roller bits are extremely well suited as hard rock tools and a suitable arrangement of lesser cutting line distances on the drill head in case of a larger radius results in assured chip removal along with a simultaneous reduction of the radial force components and the off-centered load on the drill head. In this case the arrangement of the drilling tools results in an off-centered circle of the envelope which is less than the apparent diameter of the tunnel tube wherein, if a support plate for drilling tools is used, it can be disposed as usual centered on the drill head, so that jams caused by large dislocated chunks of rock can be prevented. In this case the arrangement of the individual disks in such a way, that a circle of the envelope of the entire drilling tool which is eccentric in relation to the tube axis is created, permits the removal of the desired cleared space beyond the actual diameter of the drilling tool or the drill head.

For further minimizing the radial force components and to reduce wear, the embodiment has been advantageously provided in such a way that in relation to the axis of the drill head the tools are disposed asymmetrically, in particular on a spiral. In this case the disks on a larger diameter are arranged in a particularly advantageous manner to be inclined shallower in relation to the work face than on the lesser diameter. Both of these actions minimize wear and therefore reduce the required maintenance effort, and they are particularly advantageous in connection with the eccentricity of the cutting motion provided in accordance with the invention.

To assure the simple retraction and removal of the tunnel cutting machine or tube-driving machine, the embodiment can be advantageously provided in such a way the tunnel-driving machine is supported by means of sliding or movable supports in the tunnel tube. In this case a mobile support can be provided by means of a self-contained drive and can be embodied, for example, in the form of a tracked undercarriage. Such mobile supports must be provided separately from the actual bracing in the tunnel tube, by means of which walking is possible in principle by the removal of respectively one of the two braces and pushing ahead or bringing up the respectively other brace. With the brace pulled back, and therefore the release of the anchoring in the tunnel tube, it is possible to perform a considerably more rapid retraction of the tunnel drilling machine by means of such a mobile support, and in particular a tracked undercarriage, than would be possible with walking. Incidentally, with the use of such a sliding or mobile support the interior wall of the tunnel tube is protected during retraction.

The tunnel drilling machine or tube-driving machine in accordance with the invention is advantageously further developed in that by turning the support disk in relation to the axis of rotation of the drive, the drill head is pivotable into a position in which the exterior contour of the support disk and the drilling tools lies inside the projection onto the work face of the clear diameter of the timbered or encased tunnel tube. Following their alignment in relation to the desired tunnel axis, the individual disks basically perform a circulating movement over the work face. By displacing the drill head in the manner of an eccentric it is now possible to cause folding, by means of which a retraction of the tunnel drilling machine is made directly possible without additional measures. However, to assure retraction it is basically sufficient in most cases to bring the drill head into a defined predetermined position and subsequently to perform a pivoting of the axis in respect to the linear tunnel axis by means of a support. For this purpose the embodiment is advantageously provided such that the axis of rotation of the drive of the drilling tools can be displaced in the tunnel tube in relation to the linear tunnel axis by the front or rear support of the tunnel drilling machine. In this case the tunnel drilling machine is embodied in a simple manner to be mobile on tracks or rails or wheels and can be provided with a traveling mechanism.

By disposing the caliber tools on the support plate within a central angle of less than or equal to 90°, a particularly advantageous transfer of force simultaneously with low wear can be assured.

As a whole, no separate devices for reducing the cross section of the drilling tool are necessary with the device in accordance with the invention. As a rule, the front and rear vertical supports are necessary components of a double-braced hard rock machine, wherein walking is performed by actuation of the double bracing. The omission of an adjustment mechanism for the drilling tool reduces the breakdown tendency under rough operating conditions during drilling of hard rock. By means of the above recited structural measures of different placement of the disks it is possible to optimize the drilling tool within the circle of the envelope which is respectively to be achieved without this leading to a decrease in the possibilities for retracting the tunnel drilling machine or tube-driving machine. For the exact retraction of the drilling tool it is merely necessary to set the correct position of the drilling tools prior to returning them into the parked position. In principle the support plate or the drilling tool can also have a circumferential shape different from the shape of a circle, so that a position in which retraction is possible can be taken up by simple pivoting.

An assured pick-up of material and mobility out of the tunnel tube is assured in that the drill head has scooping tools on the support plate, whose scoop edges are disposed rigidly within the circle of the envelope of the drilling tools or retractable into the inside of the circle of the envelope.

The invention will be described in detail below by means of exemplary embodiments represented in the drawings.

DETAILED DESCRIPTION OF THE PREFERRED EMBODIMENTS

Figure 1:
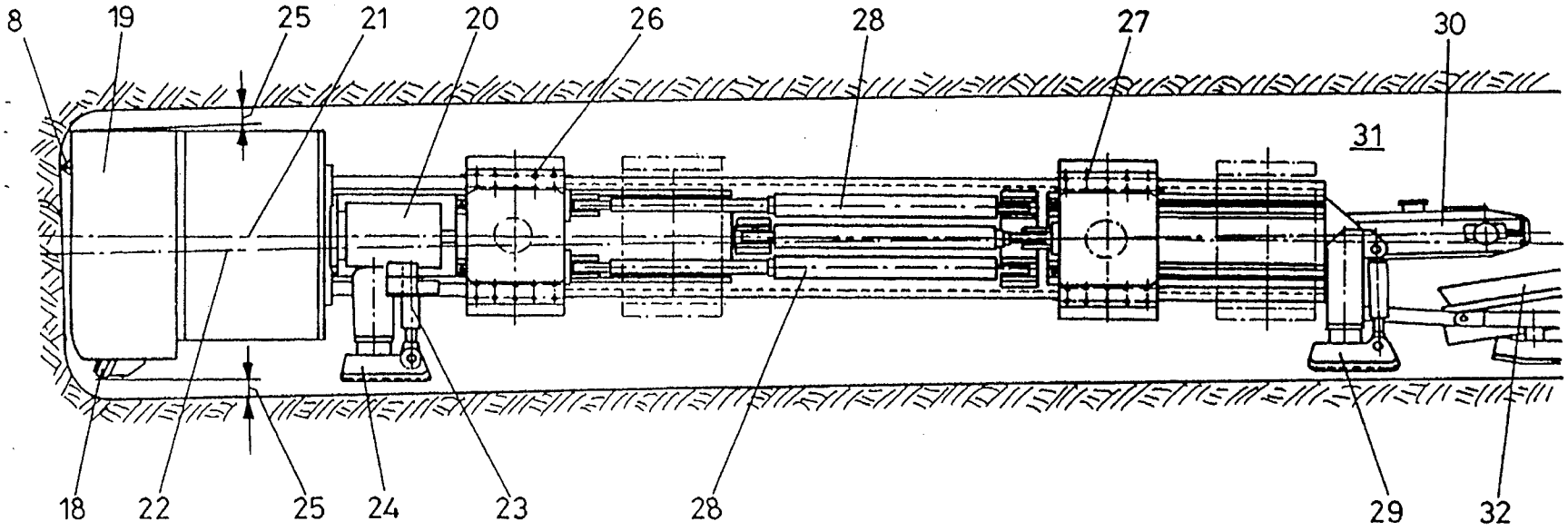
FIG. 1 is a lateral view of a tunnel-driving machine in the extended position.

The disks 1 to 18, of which only disks 8 and 18 have been drawn for the sake of clarity, can be seen connected to a drill head 19 in FIG. 1. The drill head 19 is driven by a gear motor 20 so that it is rotatable around an axis of rotation 21, wherein for cutting the axis of rotation 21 is pivoted into a position which corresponds to the linear tunnel axis 22. In the raised position illustrated in FIG. 1, wherein raising takes place by means of a hydraulic cylinder piston unit 23 of a movable support shoe 24, it is possible to accomplish the retraction of the tool out of the working position while maintaining a clear space 25. The lateral supports 26 and 27, which together with the hydraulic cylinder piston unit 28 constitute a walking device, must be retracted for this purpose. A rear support 29 is furthermore provided, which can also be embodied to be sliding, or mobile with its own drive and a tracked undercarriage. A conveyor 30 can be seen at the back end of the tunnel-driving machine, which unloads on conveying means 32 following along in the tunnel tube 31.

Figure 2:
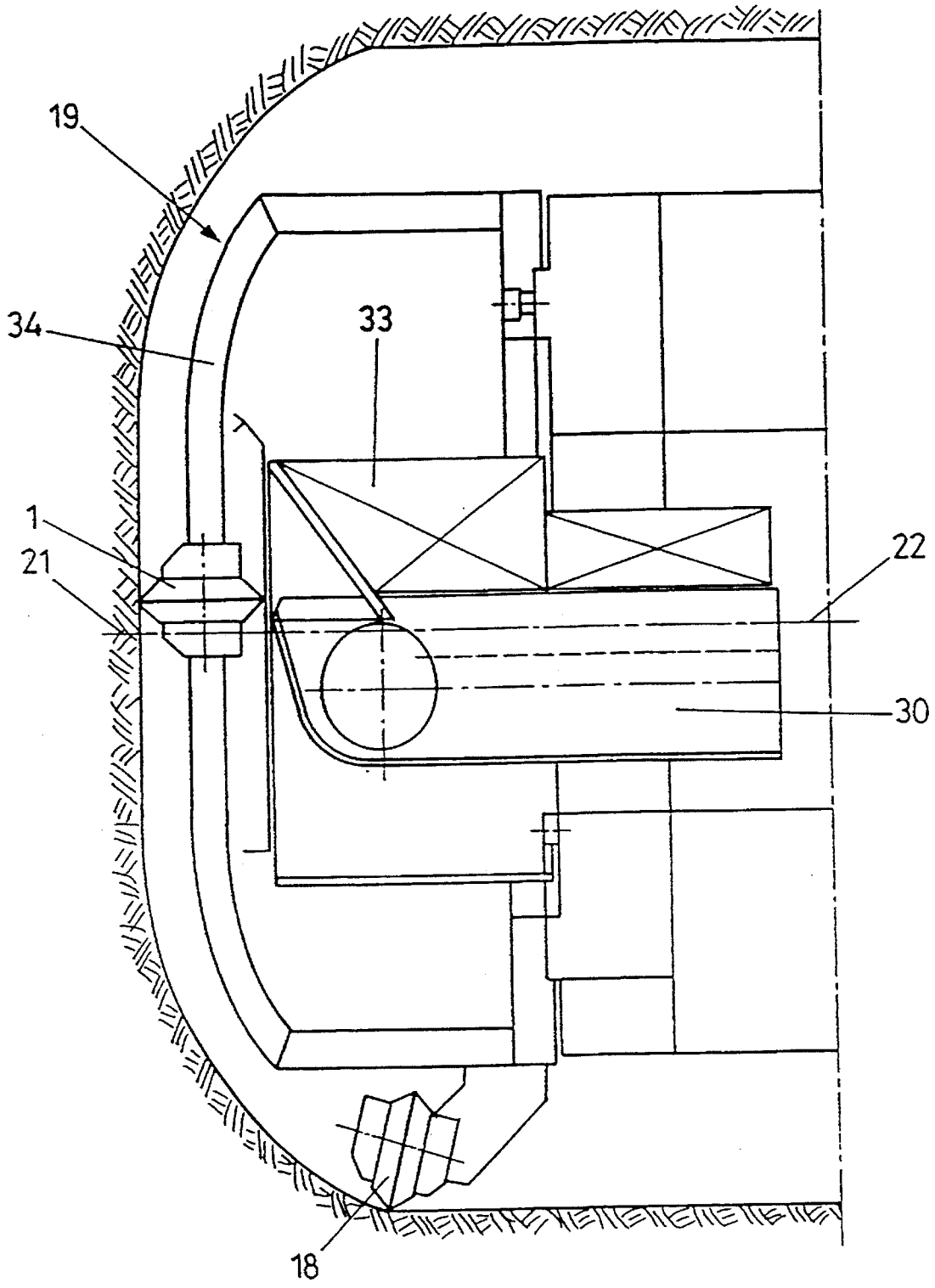
FIG. 2 is an enlarged detailed view of the full-width head in the working position.

A caliber tool 18 and a central disk 1 on the drill head 19 are again visible in the representation of FIG. 2. In this case the axis of rotation 21 coincides with the linear tunnel axis 22 and the hard rock drill head is in its working position. A large free space is cut by means of the caliber tools 18 in the course of the rotation around the axis 21 because of the eccentric disposition of the mining tools in relation to the axis of rotation 21. The cut material is transferred over guide plates 33 to the conveyor 30 and can be hauled away.

Figure 3:
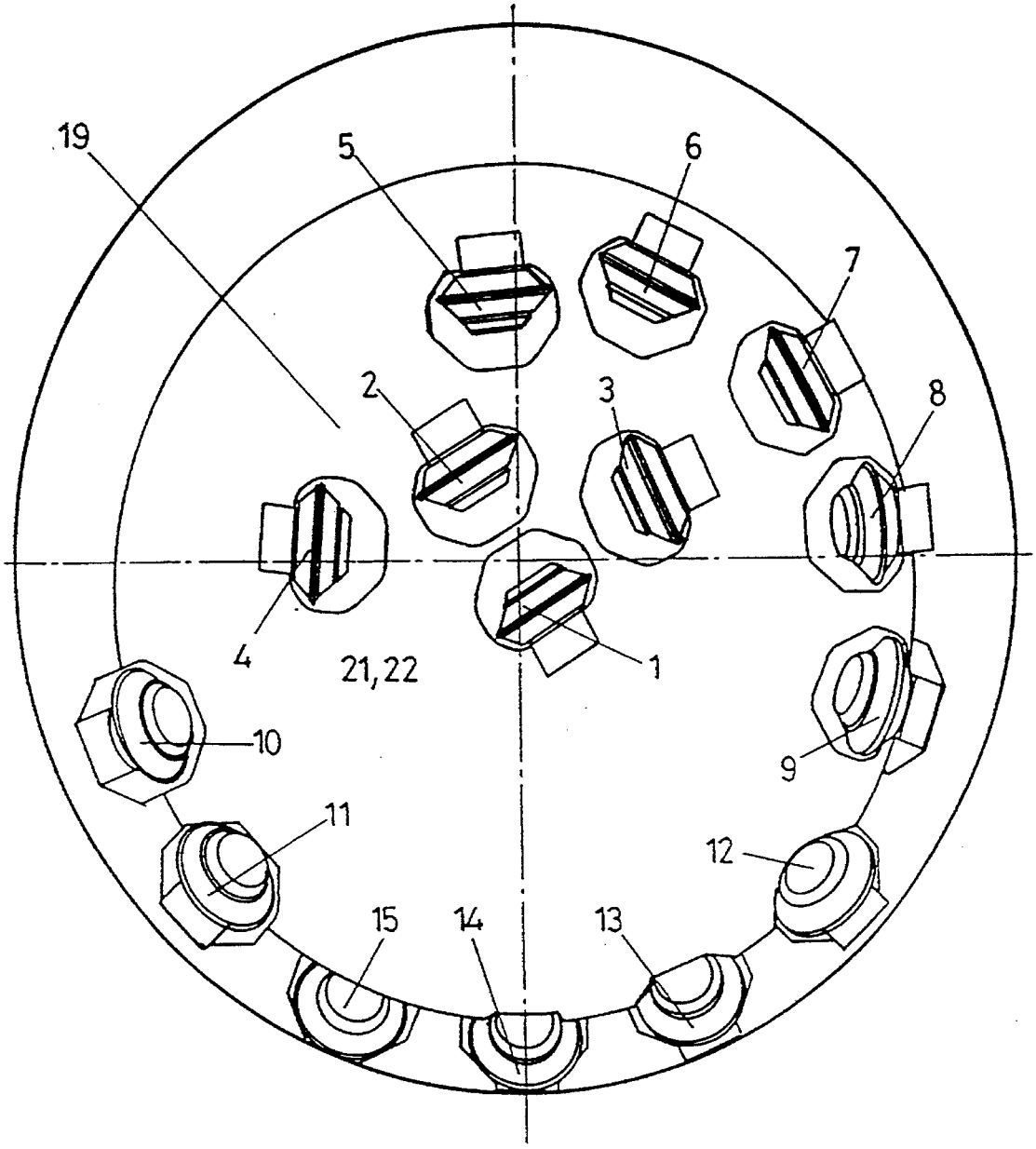
FIG. 3 is a frontal view of a full-width drill head in the working position.
Figure 4:
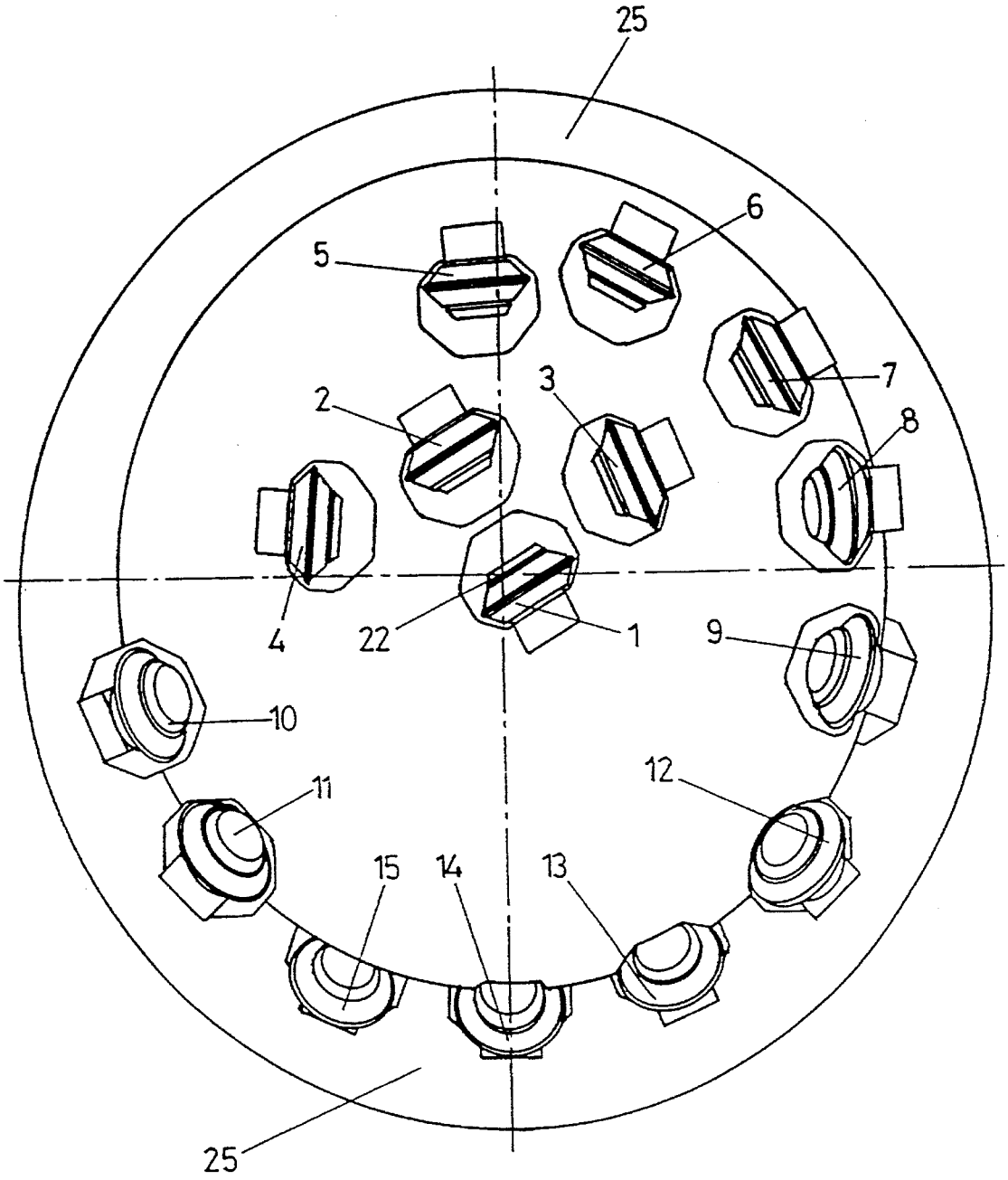
FIG. 4 is a drill head corresponding to FIG. 3 in the raised position for retraction.
Figure 5:
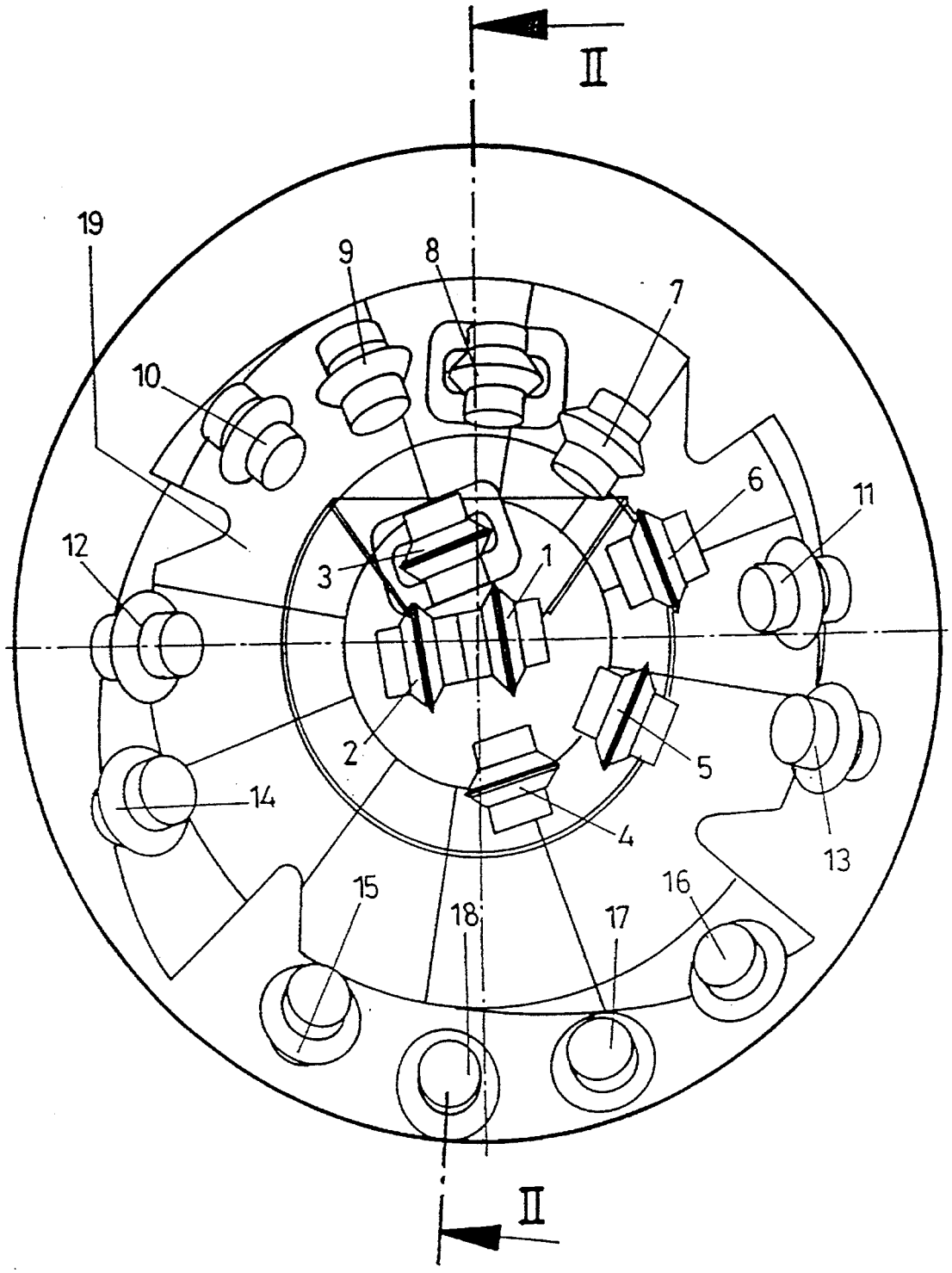
FIG. 5 is a further embodiment of a drill head with a changed disposition of the caliber tools in the working position.
Figure 6:
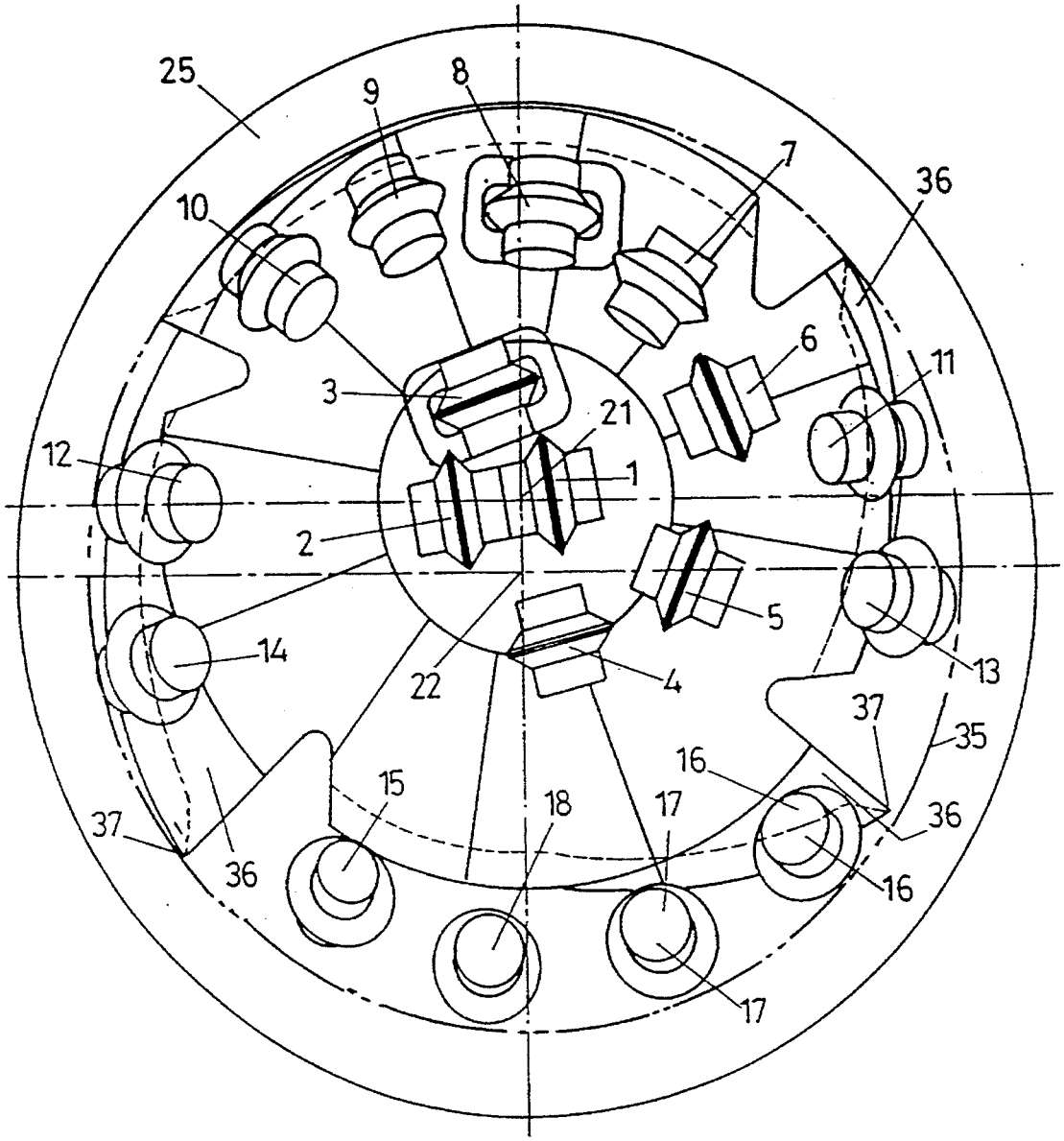
FIG. 6 is a transport position for the embodiment corresponding to FIG. 5, wherein the section line II—II represented in FIG. 5 essentially coincides with the representation in correspondence with FIG. 2.

The concrete disposition of disks on a hard rock cutting head with a support plate 34 is explained in detail by means of FIGS. 3 to 6. In FIGS. 3 to 6 the disks are identified by 1 to 18, starting at the center and extending to the outer caliber tools. It can be clearly seen that disks located on the larger diameter are inclined more shallowly in relation to the work face than disks disposed on the smaller diameter. The caliber tools 11 to 15 in FIG. 3, and 4 and 15 to 18 in FIGS. 5 and 6 are here disposed at a relatively small center angle of less the 90°, so that in combination with the inclined position of these disks radial forces can be reduced. This is true to a particular extent for the representation in accordance with FIGS. 5 and 6.

In the representation in accordance with FIG. 3, the drill head with the disks 1 to 18 is in the working position and the axis of rotation 21 coincides with the linear tunnel axis 22. Because of the asymmetric disposition of the disks, a relatively large circle is covered and, in a stationary view of the cutting head 19, the circle of the envelope of the disks has an essentially smaller radius than the paths of the drilling tools during the rotation of the cutting head 19 around the axis 21. With a displacement of the axis of rotation 21 in relation to the linear tunnel axis as represented in FIG. 4, the result is that because of the lesser circle of the envelope of the disks 1 to 18 disposed on the cutting head 19 it is now possible to take up a position in which, while assuring the free space 25, the cutting head can be retracted toward the rear again through the tunnel tube.

Analogous considerations apply to the representations in FIGS. 5 and 6. Here, again, the bits 1 to 18 are disposed in relation to the hard rock cutting head 19 on a considerably smaller diameter than would correspond to the diameter of the tunnel tube. In the working position in accordance with FIG. 5, the caliber tools 15, 16, 17 and 18 are moved over a greater path diameter. If, as represented in FIG. 6, the axis of rotation 21 is raised in relation to the linear tunnel axis 22, the largest circle 35 of the envelope of the drilling tools 1 to 18 is located inside of the clear cross section of the tunnel and, while leaving the free space 25 clear, a retraction of the cutting head can again take place without danger of a collision with the tunnel tube. In this case and as can be seen from FIGS. 3 to 6, the distances of the cutting lines have been selected in such a way that by means of an essentially more shallow placement of the drilling tools a considerably shorter distance between the cutting lines is maintained in the outer area than in the central area of the bore. In contrast to known hard rock cutting heads the cutting rollers are disposed asymmetrically in order to result in an optimization in respect to the radial forces.

As shown in more detail in FIGS. 5 and 6, the drill head has scooping tools 36 on the support plate, whose scooping edges 37 are disposed inside the circle 35 of the envelope. These scooping tools can be selectively connected rigidly with the support plate or they can be embodied to be folded inside the circle of the envelope for movement out of the tunnel tube.

What is claimed is:

1. A tunnel drilling machine for drilling a bore in hard rock by means of a rotatably seated drill head which supports drilling tools, wherein the drill head has a diameter less than the diameter of the bore and wherein said machine includes means for selectively displacing an axis of rotation of said drill head angularly of a longitudinal axis of the bore to facilitate removal of the drill head from said bore.

2. A tunnel drilling machine according to claim 1, wherein the drill head includes a support disk on which the drilling tools for cutting hard rock are disposed eccentrically of the rotational axis of the drill head so as to move along individual cutting lines about said rotational axis as said drill head is rotated, the drilling tools being so disposed on the support disk that distances between cutting lines decrease as the radii of the drilling tools from the rotational axis increase.

3. A tunnel drilling machine according to claim 2, wherein the drilling tools are disposed asymmetrically of the rotational axis in a spiral pattern.

4. A tunnel drilling machine according to claim 2 or 3, wherein the drilling tools are arranged to perform a shallower cut on a work face of the hard rock as the radii of such devices from the rotational axis increases.

5. A tunnel drilling machine according to claim 4, wherein the machine is supported within the bore by movable supports.

6. A tunnel drilling machine according to claim 5, wherein at least one of said movable supports is actuated to selectively displace the axis of rotation of said drill head relative to the longitudinal axis of the bore.

7. A tunnel drilling machine according to claim 1, 2 or 3, wherein said machine is movable within the bore in the direction of the longitudinal axis of the bore.

8. A tunnel drilling machine according to claim 2 or 3, wherein the drilling tools located at the four longest radii from the rotational axis of the drill head are disposed on the drill head within a 90° segment of said head.

9. A tunnel drilling head according to claim 1, 2 or 3, wherein said drill head includes scooping tools positioned along the periphery of the drill head, said scooping tools having scoop edges which are selectively retractable from positions at an edge of a circular envelope defined by rotation of the drill head.

10. A tunnel drilling machine according to claim 4, wherein said machine is movable within the bore in the direction of the longitudinal axis of the bore.

11. A tunnel drilling machine according to claim 4, wherein the drilling tools located at the four longest radii from the rotational axis of the drill head are disposed on the drill head within a 90° segment of the head.

12. A tunnel drilling head according to claim 4, wherein said drill head includes scooping tools positioned along the periphery of the drill head, said scooping tools having scoop edges which are selectively retractable from positions at an edge of a circular envelope defined by rotation of the drill head.

13. A tunnel drilling machine according to claim 1, wherein the machine is supported within the bore by movable supports.

14. A tunnel drilling machine according to claim 13, wherein at least one of said movable supports is actuated to selectively displace the axis of rotation of said drill head relative to the longitudinal axis of the bore.

15. A tunnel drilling machine for drilling a bore in hard rock by means of a rotatably seated drill head which supports drilling tools positioned at difference distances from an axis of rotation of the drill head so as to describe, when said drill is rotated, an envelope having a diameter greater than a diameter of the drill head, said machine including means for selectively displacing a geometric axis of said envelope eccentrically of a longitudinal axis of the bore to facilitate removal of the drill head from said bore.

16. A tunnel drilling machine according to claim 15, wherein the drill head includes a support disk on which the drilling tools for cutting hard rock are disposed eccentrically of the rotational axis of the drill head so as to move along individual cutting lines about said rotational axis as said drill head is rotated, the drilling tools being so disposed on the support disk that distances between cutting lines decrease as the radii of the drilling tools from the rotational axis increase.

17. A tunnel drilling machine according to claim 16, wherein the drilling tools are disposed asymmetrically of the rotational axis in a spiral pattern.

18. A tunnel drilling machine according to claim 16 or 17, wherein the drilling tools are arranged to perform a shallower cut on a work face of the hard rock as the radii of such tools from the rotational axis increases.

19. A tunnel drilling machine according to claim 18, wherein the machine is supported within the bore by movable supports.

20. A tunnel drilling machine according to claim 19, wherein at least one of said movable supports is actuated to selectively displace the axis of rotation of said drill head relative to the longitudinal axis of the bore.

21. A tunnel drilling machine according to claim 15, 16 or 17, wherein said machine is movable within the bore in the direction of the longitudinal axis of the bore.

22. A tunnel drilling machine according to claim 16 or 17, wherein the drilling tools located at the four longest radii from the rotational axis of the drill head are disposed on the drill head within a 90° segment of said head.

23. A tunnel drilling head according to claim 15, 16 or 17, wherein said drill head includes scooping tools positioned along the periphery of the drill head, said scooping tools having scoop edges which are selectively retractable from positions at an edge of a circular envelope defined by rotation of the drill head.

24. A tunnel drilling machine according to claim 18, wherein said machine is movable within the bore in the direction of the longitudinal axis of the bore.

25. A tunnel drilling machine according to claim 18, wherein the drilling tools located at the four longest radii from the rotational axis of the drill head are disposed on the drill head within a 90° segment of the head.

26. A tunnel drilling head according to claim 18, wherein said drill head includes scooping tools positioned along the periphery of the drill head, said scooping tools having scoop edges which are selectively retractable from positions at an edge of a circular envelope defined by rotation of the drill head.

27. A tunnel drilling machine according to claim 15, wherein the machine is supported within the bore by movable supports.

28. A tunnel drilling machine according to claim 27, wherein at least one of said movable supports is actuated to selectively displace the axis of rotation of said drill head relative to the longitudinal axis of the bore.

* * * * *